US006195023B1

(12) United States Patent
Walsh et al.

(10) Patent No.: US 6,195,023 B1
(45) Date of Patent: Feb. 27, 2001

(54) COMMUNICATION BASED VEHICLE POSITIONING REFERENCE SYSTEM

(75) Inventors: Robert E. Walsh, McCandless; Joseph A. Greco, II, Washington, both of PA (US)

(73) Assignee: DaimlerChrysler AG (DE)

( * ) Notice: Subject to any disclaimer, the term of this patent is extended or adjusted under 35 U.S.C. 154(b) by 0 days.

(21) Appl. No.: 09/208,788

(22) Filed: Dec. 10, 1998

Related U.S. Application Data

(63) Continuation-in-part of application No. 08/794,617, filed on Feb. 3, 1997, now abandoned.

(51) Int. Cl.[7] ..... G08G 1/123

(52) U.S. Cl. ..... 340/988; 246/5; 246/20; 246/122 R; 340/933; 701/19

(58) Field of Search ..... 346/988, 933, 346/903, 995, 990; 246/122 R, 20, 29 R, 3, 5, 28 R; 701/1, 19, 20, 50, 117; 180/167

(56) References Cited

U.S. PATENT DOCUMENTS

| | | | |
|---|---|---|---|
| 3,470,370 | 9/1969 | Landow . | |
| 3,794,834 | 2/1974 | Auer, Jr. et al. | 246/187 B |
| 3,888,437 | 6/1975 | Birkin | 246/63 R |
| 3,901,468 | 8/1975 | Cochran et al. | 246/28 R |
| 4,042,810 | 8/1977 | Mosher | 235/150.2 |
| 4,641,243 | 2/1987 | Hartkopf et al. | 246/131 |
| 4,863,123 | 9/1989 | Bernard et al. | 246/122 R |
| 4,864,306 | 9/1989 | Wiita | 340/991 |
| 5,072,900 | 12/1991 | Malon | 246/5 |
| 5,129,605 | 7/1992 | Burns et al. | 246/5 |
| 5,340,062 | 8/1994 | Heggestad | 246/5 |
| 5,364,047 | 11/1994 | Petit et al. | 246/122 R |
| 5,420,883 | 5/1995 | Swensen et al. | 342/450 |
| 5,533,695 | 7/1996 | Heggestad et al. | 246/62 |
| 5,555,503 | 9/1996 | Kyrtsos et al. . | |
| 5,574,469 | 11/1996 | Hsu | 342/357 |

FOREIGN PATENT DOCUMENTS 2641512 7/1990 (FR) .

*Primary Examiner*—Brent A. Swarthout
(74) *Attorney, Agent, or Firm*—Webb Ziesenheim Logsdon Orkin & Hanson, P.C.

(57) ABSTRACT

A communication based vehicle positioning reference system that includes a vehicle path. The vehicle path is divided into regions, wherein the regions contain a portion of the vehicle path. Each portion of the vehicle path contained within a respective region is defined by one or more segments. A position of a vehicle on the vehicle path is identified by a local coordinate system $S_{xyz}$, where S is a vehicle identifier, $_x$ is a specific region, $_y$ is a specific segment contained within the region and $_z$ is the position of the vehicle within the specific segment. The vehicle path can be represented on a map. Each of the segments can be identified by a character string that includes the indicia relating to the region the segment is located and a segment name. A plurality of computers can be provided which include only a portion of the map. Also, disclosed is a method for identifying the position of a vehicle along a vehicle path.

26 Claims, 9 Drawing Sheets

COMMUNICATION BASED VEHICLE POSITIONING REFERENCE SYSTEM

CROSS-REFERENCE TO RELATED APPLICATION

This is a continuation-in-part of copending U.S. patent application Ser. No. 08/794,617 filed Feb. 3, 1997, entitled "Communication Based Positioning Reference System", now abandoned.

BACKGROUND OF THE INVENTION

1) Field of the Invention

The present invention relates to a system for identifying the location of a vehicle through modeling the vehicle path and the wayside, and more particularly modeling a train on a track.

2) Description of the Prior Art

Until recently, identifying the location of a train on a train track was an inexact science. Specifically, a train track was divided into fixed sections known as blocks. Once a particular train entered a block, no other trains could enter that block since the exact location of the train was unknown.

The "fixed blocks" can vary in length from hundreds of feet to miles on a particular track. In many instances, the fixed block arrangement adversely affects a train's schedule by preventing a train to enter a block even though it is a safe distance from the next closest train that just happens to be located in that block.

Recently, the concept of a "moving block" has been proposed. A moving block system is a dynamic system which creates an imaginary space or block that moves along with a particular vehicle as it travels along a track where no other train or vehicle may enter that space. The length of the moving block depends on various characteristics, such as train speed, train braking ability, etc. A simple example of a moving block is a space which extends one hundred feet in front of and one hundred feet behind a particular train. Through appropriate communication devices and computers, the appropriate safe distance between trains can be continuously calculated and this safe distance can then be identified as the moving block that moves along with the train. The length of the moving block varies as the operating parameters of the train change.

A train system implementing the moving block system requires an onboard computer for each train and one or more wayside computers to communicate with the trains. A problem in implementing this moving block technology into large scale train systems is the size of the computers necessary to operate and communicate to the trains. Another major problem in a train system, be it a subway train system or a large scale interstate train system, is how to identify the location of the train. Each train system identifies a vehicle location differently. Therefore, a problem exists in automatic train control systems as to how train positions can be identified universally, be it in a New York subway or in a train system for a train traveling across the United States.

Further, prior art methods that model the track and the wayside typically require several databases to model the wayside, such as a database for maximum civil speed, track grade, etc. This requires a substantial amount of computer memory and results in relatively slow processing time when monitoring a vehicle on a vehicle pathway modeled via all of these databases.

Therefore, it is an object of the present invention to provide a universal communication based vehicle positioning reference system.

It is another object of the present invention to provide a vehicle positioning system that can operate through a plurality of computers rather than one central computer.

It is yet another object of the present invention to provide an improved model of a vehicle system.

SUMMARY OF THE INVENTION

The present invention is a method for defining a reference system to provide for identifying a position of a vehicle along the vehicle path and includes the steps of providing the vehicle path; dividing the vehicle path into regions, wherein the regions contain a portion of the vehicle path; identifying each portion of the vehicle path contained within the respective region by one or more segments; providing a vehicle on the vehicle path; and identifying a position of the vehicle on the vehicle path by a local coordinate system $S_{xyz}$ where S is a vehicle identifier, $_x$ is a specific region, $_y$ is a specific segment contained within the region and $_z$ is the position of the vehicle within the specific segment.

Another aspect of the present invention is a map for a vehicle transport system that includes one or more regions. A plurality of segments are provided in each of the regions. The segments represent a path adapted for a vehicle to travel. Each of the segments is identified by an indicia relating to the region in which the segment is located and a segment name. The segments are used to model a wayside of a vehicle system.

Further, the vehicles and one or more wayside computers utilize the above map for providing tracking and control of a vehicle along a vehicle pathway.

DESCRIPTION OF THE PREFERRED EMBODIMENTS

Figure 1:
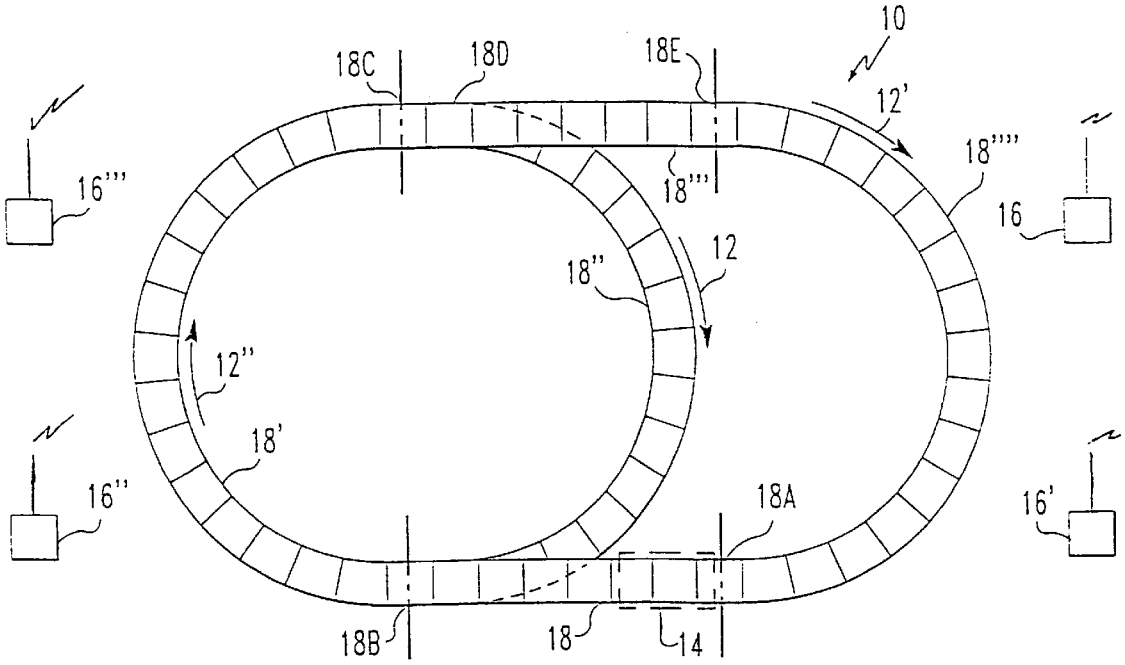
FIG. 1 is a top plan view of a vehicle track and a vehicle car, in phantom, traveling along the vehicle track.

FIG. 1 shows a vehicle track 10, such as a train track, defined by a plurality of paths 12, 12' and 12". A vehicle car 14, such as a train car, is adapted to travel on the vehicle track 10. A plurality of computers 16, 16', 16" and 16'" is provided to communicate with the vehicle car 14. Preferably, the computers 16, 16', 16" and 16'" and the vehicle car 14 communicate via radio transmitters and receivers. Also, the computers 16, 16', 16" and 16'" are adapted to communicate with each other. As shown in FIG. 1, the vehicle track 10 is also divided into fixed blocks 18, 18', 18" and 18'" defined by block end points 18A, 18B, 18C, 18D and 18E. In the specific example shown in FIG. 1, the vehicle car 14 is positioned in fixed block 18 defined by block end points 18A and 18B. Under conventional fixed block operations, no vehicle can enter fixed block 18 until the vehicle car 14 leaves block 18. This particular arrangement is an inefficient use of the vehicle track 10 since a vehicle must wait until the vehicle car 14 completely exits fixed block 18 before it can enter fixed block 18.

Figure 2:
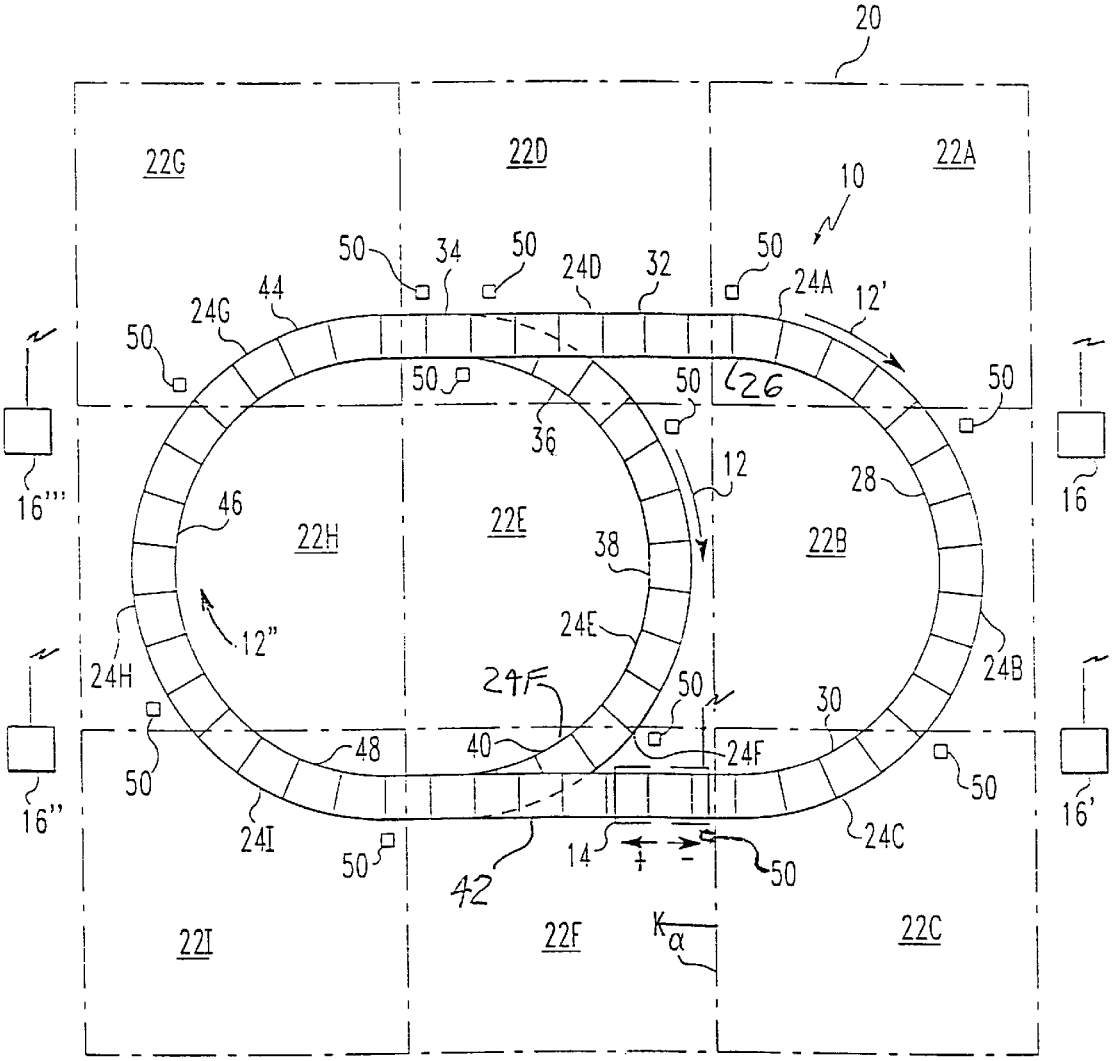
FIG. 2 is a top plan view of a map showing the vehicle track and the vehicle car shown in FIG. 1.

FIG. 2 shows a map 20, including representations of the vehicle track 10, vehicle car 14 and computers 16, 16', 16" and 16'" made in accordance with the present invention. The map area containing the vehicle track 10 is divided into areas or regions 22A, 22B, 22C, 22D, 22E, 22F, 22G, 22H and 22I. Each of the regions contains specific portions 24A, 24B, 24C, 24D, 24E, 24F, 24G, 24H and 24I of the vehicle track 10. Each region portion 24A–24I of the track is divided into one or more segments of track 26, 28, 30, 32, 34, 36, 38, 40, 42, 44, 46 and 48.

An onboard computer is provided with the vehicle car 14 that includes a microprocessor based automated control system which may control the speed and the brakes of the vehicle car 14. One such control system can be of the type disclosed in U.S. Pat. No. 5,364,047, which is hereby incorporated by reference. The onboard computer also automatically tracks the vehicle location and also includes databases for vehicle characteristics, braking performance and engine performance and a map database that represents the track layout, civil speed limits, track grades, locations of all of the vehicle stations positioned along the track and any other relevant position data.

The vehicle car 14 includes a tachometer. The tachometer is a standard vehicle tachometer that measures the rotational displacement and direction of one of the vehicle axles attached to the vehicle wheels. The tachometer is coupled to the appropriate instrumentation so as to measure rotational displacement and direction. The tachometer is also coupled to the onboard computer so that tachometer information can be relayed to the onboard computer. Specifically, the distance the vehicle has traveled over a fixed period of time equals the number of axle rotations multiplied by the circumference of the wheels attached to the axle.

Tags 50 (also known as beacons, position identifiers, transmitters or transponders) are positioned about the vehicle track 10. A vehicle reader, receiver or interrogator is secured to vehicle car 14 and is adapted to read or receive signals emitted from tags 50 that represent identifying an exact location of the tags 50 positioned along the vehicle track 10.

The above-described tag/reader system is a radio-based communication system, which uses radio frequency (RF) communication between the vehicle reader and tags 50. The tag/reader system could also be optically based or inductively based. A passive transponder, enclosed with location information, is excited by RF energy from vehicle-based radar. The location information is received by the radar and is then sent to the onboard computer so that the vehicle's location can be pinpointed by the onboard computer map. The onboard tachometer provides displacement information to the onboard computer when the vehicle travels between the tags 50.

As can been seen in FIG. 2, the tags 50 are positioned adjacent a point of entry into a respective segment. The tags 50 contain characteristic information about the segment, such as the maximum vehicle speed permitted along the segment, the segment grade, the segment curvature, switch point information, end of track information and vehicle station information. Further, specific position identification information is provided on the tags 50, namely, the specific region (22A–22I) of the tags and the specific segments (26, 28, 30, 32, 34, 36, 38, 40, 42, 44, 46 and 48) adjacent the respective tags 50.

This specific characteristic information is then transmitted to the vehicle onboard computer, which can then pinpoint the vehicle's position on the map 20 and can be used in the control of the vehicle's speed. As the vehicle travels along the segment between the respective tags 50, the actual vehicle position is then determined by the distance the vehicle traveled within the specific segments. This information is then transmitted to one or more of the wayside computers 16, 16', 16" and 16'". The position information is transmitted in the form of $S_{xyz}{}^{A}$ where:

S is a vehicle identifier;

$^{A}$ identifies the direction of travel of the vehicle (+ for a positive direction and—for a negative direction);

$_{x}$ is a specific region;

$_{y}$ is a specific segment contained within the region; and $_{z}$ is the position of the vehicle within the specific segment.

Thus, for the example shown in FIG. 2, the position of the vehicle car 14 could be: vehicle $\mathbf{14}_{22F,42,\alpha}{}^{+}$ which translates into vehicle car 14 traveling in the + direction in region 22F an $\alpha$ distance along segment 42. Either the onboard computer or the wayside computers 16, 16', 16" and 16'" which received the inputted vehicle position $S_{xyz}{}^{A}$ and segment characteristics determine the permittable vehicle speed on the respective segment based upon the inputted information. The respective computer then operates the vehicle at the permittable speed.

A map, such as map 20, could easily be stored on a standard personal computer. However, a map for complex subway systems with hundreds of miles of track may require more powerful computers. The map permits modeling of the vehicle track 10 through segment identifiers and the vehicle identifier coordinate system $S_{xyz}{}^{A}$ as will be discussed in more detail hereinafter.

Figure 3:
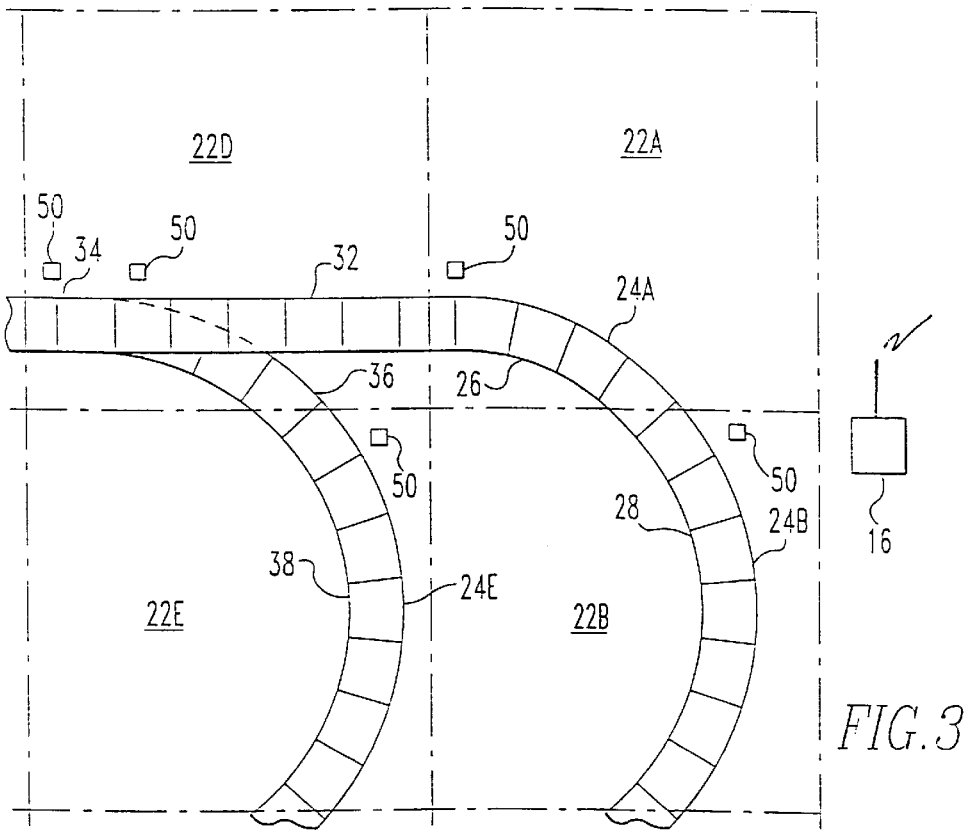
FIG. 3 is a portion of a map shown in FIG. 2.
Figure 4:
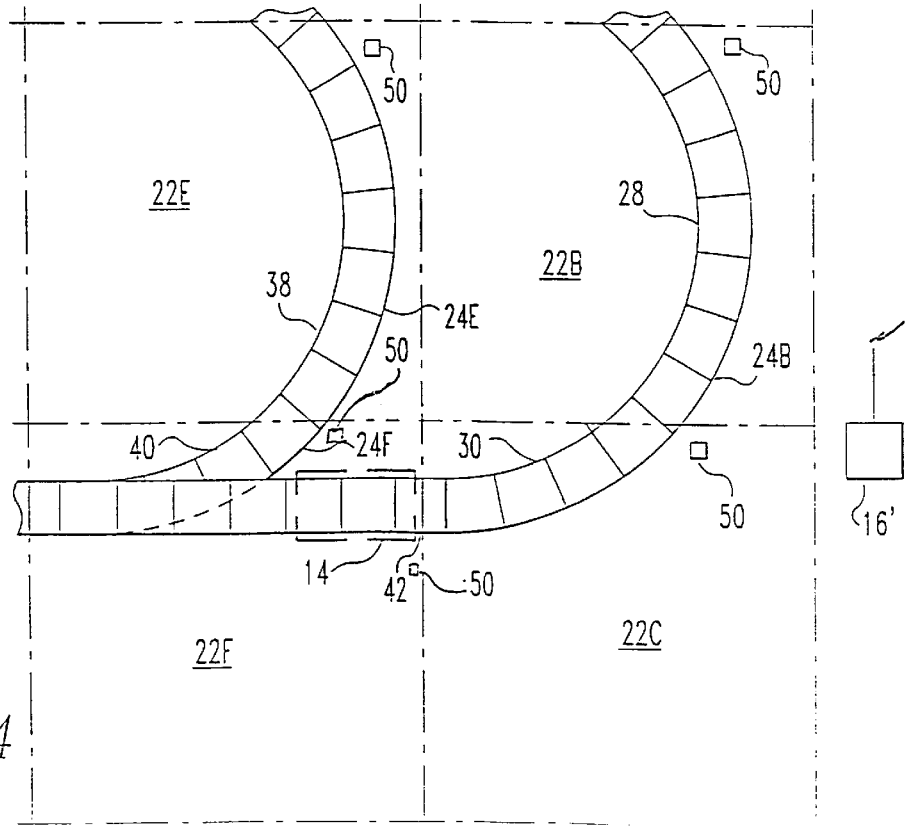
FIG. 4 is a portion of a map shown in FIG. 2.
Figure 5:
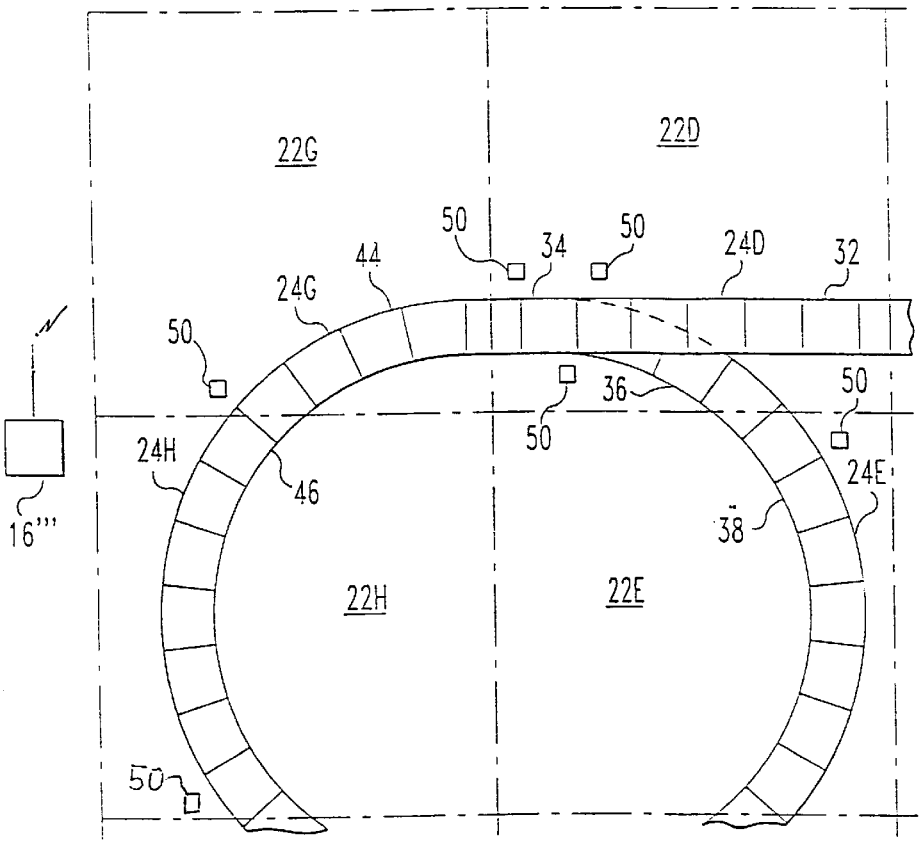
FIG. 5 is a portion of a map shown in FIG. 2.
Figure 6:
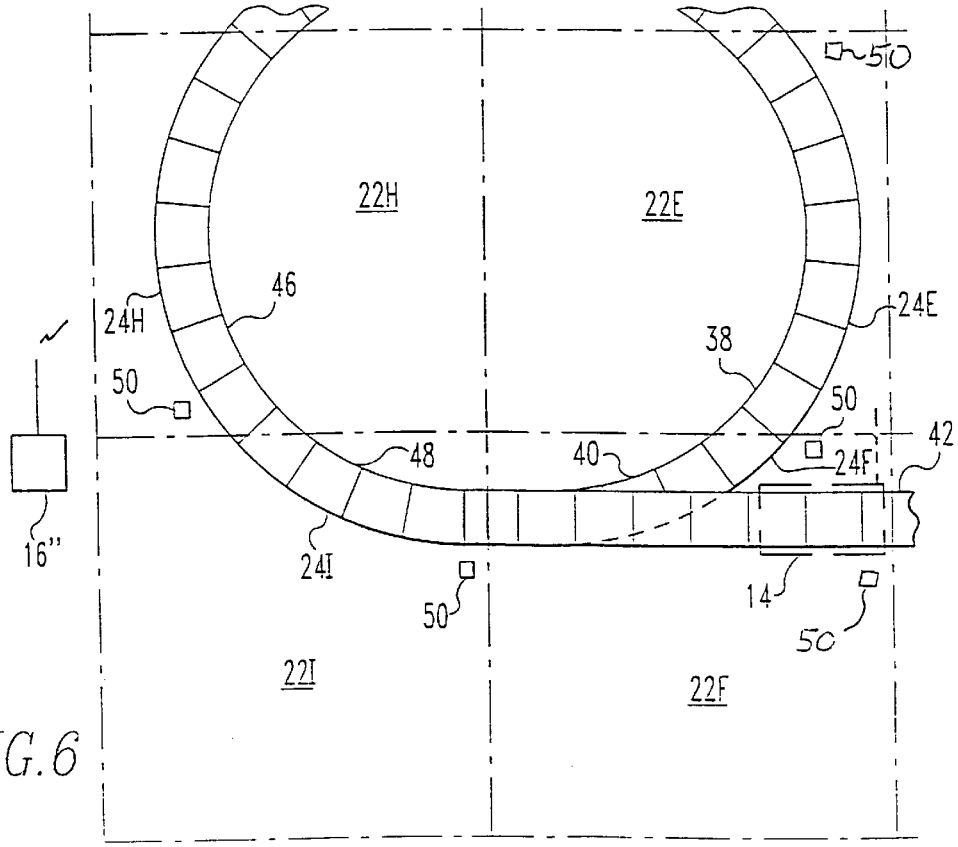
FIG. 6 is a portion of a map shown in FIG. 2.

The present invention solves this problem by providing a plurality of computers 16, 16', 16" and 16'" positioned about the vehicle track 10. Each of the computers 16, 16', 16" and 16'" can communicate with each other by directly being coupled or by radio communication to each other, as well as communicate with the onboard computer of the vehicle car 14 or other vehicles on the vehicle track 10. Each of the computers 16, 16', 16" and 16'" includes a portion of a map 20 in their respective memory, which corresponds to a portion of the vehicle track 10. FIG. 3 shows a schematic representation of a portion of map 20 stored in the memory of the computer 16 and includes regions 22A, 22B, 22D and 22E. FIG. 4 shows a representation of a portion of map 20 stored in the memory of the computer 16' and includes regions 22B, 22C, 22E and 22F. FIG. 5 shows a schematic representation of a portion of map 20 stored in the memory of the computer 16''' and includes regions 22D, 22E, 22G and 22H. FIG. 6 shows a schematic representation of a portion of the map 20 stored in the memory of the computer 16'' and includes regions 22E, 22F, 22H and 22I. The respective computers 16, 16', 16'' and 16''' communicate with the vehicle car 14 when it travels within respective regions stored in the computer memory. As can be seen, preferably there is an overlap of a portion of the map contained within the memories of respective computers 16, 16', 16'' and 16'''. In other words, at least two computers have map information that corresponds to the same portions of the vehicle track 10. Computers 16, 16', 16'' and 16''' can then communicate with each other and/or a central computer and/or the vehicle onboard computer relaying information relating to the vehicle location, vehicle speed and vehicle schedule to the vehicle onboard computer. Further, if more than one vehicle is on the vehicle track, then they can relay their positions to each other or to the computers 16, 16', 16'' or 16'''.

Figure 7:
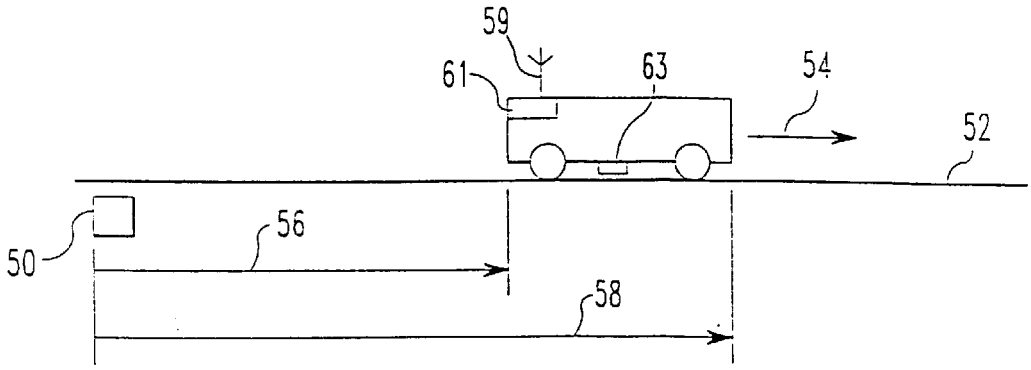
FIG. 7 is a side elevational view of a vehicle car traveling on a track segment.

FIG. 7 shows the vehicle car 14 within a track segment 52. In this arrangement, the vehicle car 14 transmits its direction 54 and distance $\alpha$ it has traveled, either as measured from the rear of the vehicle 56 or from the front of the vehicle 58, to one or more of the computers 16, 16', 16'' and 16''' via a transmitter 59. In this manner, the vehicle car 14 transmits its location to at least one of the computers 16, 16', 16'' and 16'''. The computers can then communicate the vehicle location amongst each other. The transmitter 59 is coupled to a vehicle computer 61, which can control the vehicle speed and position along the track and includes such information as vehicle characteristics and a map. The computer is also coupled to an interrogator 63 for reading the tags 50. The vehicle speed is also subject to other vehicles positioned along the track 10.

Hence, in the present invention, the vehicle's location can quickly be determined by the information $S_{xyz}^{A}$. This information then can be either transcribed into global coordinates $S_{x'y'}$ such as a longitude coordinate reading $_{x'}$ and a latitude coordinate reading $_{y'}$ or other specific local coordinates unique to a specific train or vehicle line. Using the above-described coordinate system will permit a vehicle or other vehicle to travel on any vehicle track system and communicate its location to either a central dispatch or local computer.

Figure 8:
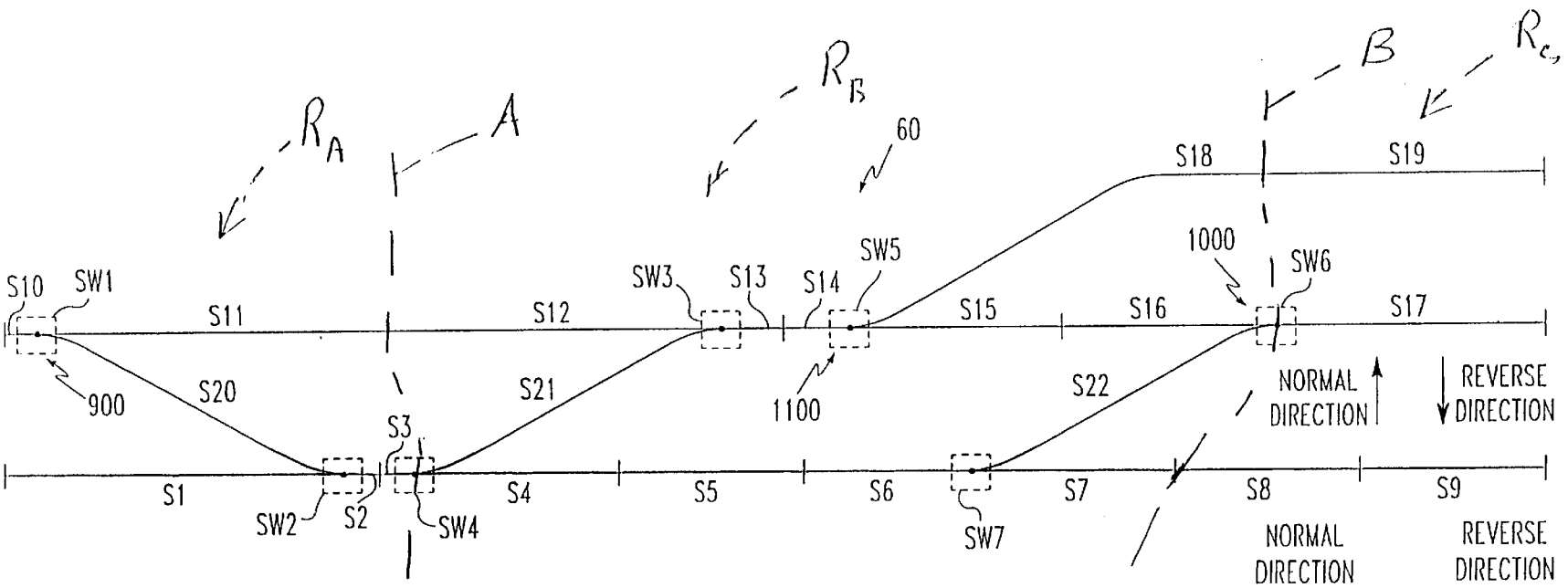
FIG. 8 is a schematic view of a map made in accordance with the present invention.

FIG. 8 shows a schematic representation of another vehicle system map 60 having only one region made up of six tracks and twenty-two segments S1–S22, where: segments S1–S9 make up track 1; segments S10–S17 make up track 2; segments S18 and S19 make up track 3; and segments S20–S22 make up tracks 4–6, respectively. An important aspect of the present invention is that a segment need not be limited to a length of track, but could also represent switches SW1–SW7. Alternatively, FIG. 8 shows the vehicle system map 60 broken into a plurality of regions $R_A$, $R_B$ and $R_C$, defined by boundaries A and B, all shown in phantom.

Generally, two positions are identified with each of the switches SW1–SW7, a normal position and a reverse position. When switch SW1 is in the normal position, then a vehicle traveling along segment S10 will travel to segment S11. A vehicle traveling along segment S10 will travel to segment S20 when SW1 is in a reverse position. A vehicle traveling along segment S1 will travel to segment S2 when SW2 is in a normal position. A vehicle traveling along segment S20 will travel to segment S2 when switch SW2 is in a reverse position.

As should now be evident, each of the switches SW1–SW7 can have a normal and a reverse position. These positions will identify a vehicle's path along a plurality of segments. Hence, identification of switches along the vehicle track in this manner can easily assist in identifying a vehicle path by identifying whether the switch is in the normal or reverse position. This arrangement will also aid in computer modeling of vehicle systems.

Figure 9:
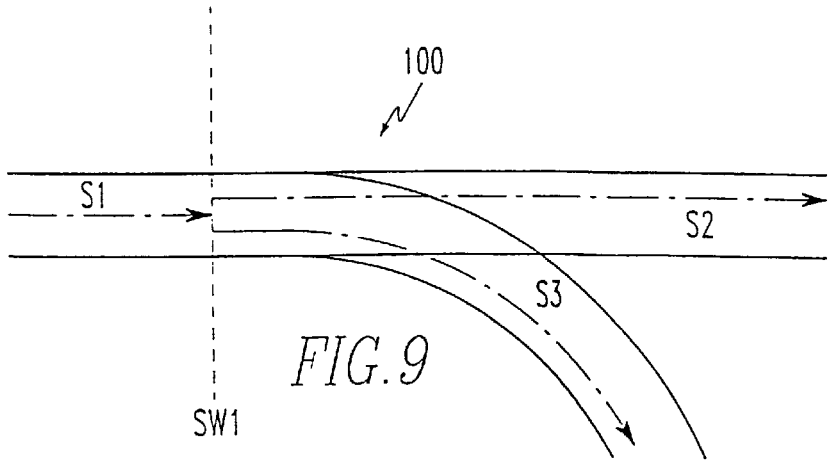
FIG. 9 is a schematic view of a gauntlet portion of track for travel by a vehicle.
Figure 10:
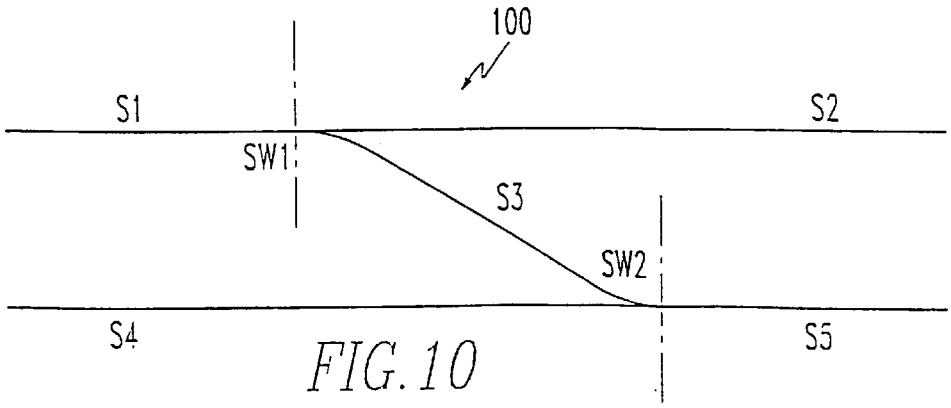
FIG. 10 is a schematic view of a cross-over portion of track for travel by a vehicle.

FIGS. 9–17 show various schematics of representative arrangements of track which can be utilized in a map made in accordance with the present invention. FIGS. 9 and 10 show a schematic view of a gauntlet portion of track 100 defined by three segments S1–S3 and one switch SW1. The gauntlet track portion switch has two states: normal and reverse. The normal state, which is controlled by the position of switch SW1, results in segments S1 being directly coupled to segment S2, and the reverse state of switch SW1 results in segment S1 being directly coupled to segment S3. When switch SW1 is in the normal state, switch SW2 is likewise in a normal state wherein segment S4 is directly coupled to segment S5. Segment S5 is directly coupled to segment S3 when switches SW1 and SW2 are in the reverse state.

Figure 11:
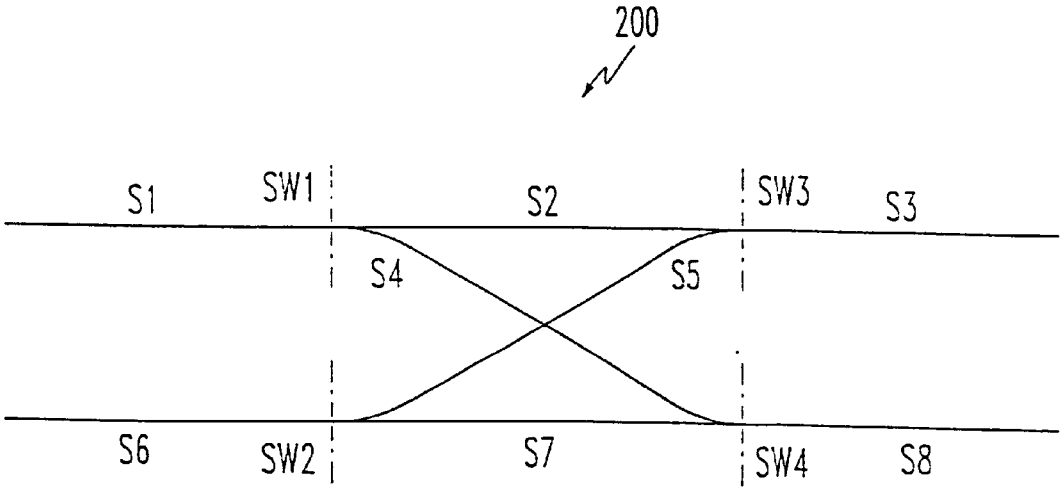
FIG. 11 is a schematic view of a scissor cross-over portion of track for travel by a vehicle.

FIG. 11 shows a schematic view of a scissor cross-over portion of track 200 defined by eight segments S1–S8, and four switches SW1–SW4. Each of the cross-over portion switches SW1–SW4 has two states: normal and reverse. In the normal state, switches SW1–SW4 are arranged so that segments S1–S3 are directly coupled and segments S6–S8 are directly coupled. In the reverse state, switches SW1–SW4 are arranged so that segments S1 and S8 are directly coupled to segment S4 and segments S6 and S3 are directly coupled to segment S5.

Figure 12:
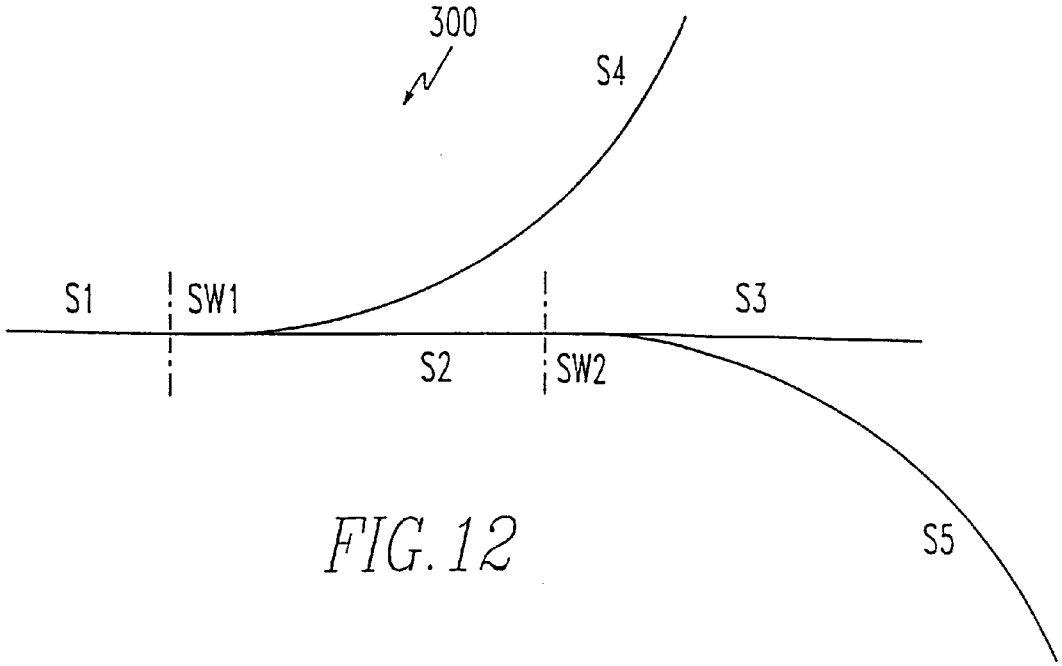
FIG. 12 is a schematic view of an interlaced switch portion of track for travel by a vehicle.

FIG. 12 is a schematic view of an interlaced portion of track 300 defined by five segments S1–S5 and two switches SW1 and SW2. Each of the switches, SW1 and SW2 are arranged so that in a normal state, segments S1–S3 are directly coupled. In a reverse state, switches SW1 and SW2 are arranged so that segments S1 and S4 and S2 and S5, respectively, are directly coupled. As should now be evident, in operation one switch, for example, SW1, can be in the normal state and the other switch, for example, SW2, can be in the reverse state so that segments S1, S2 and S5 are directly coupled.

Figure 13:
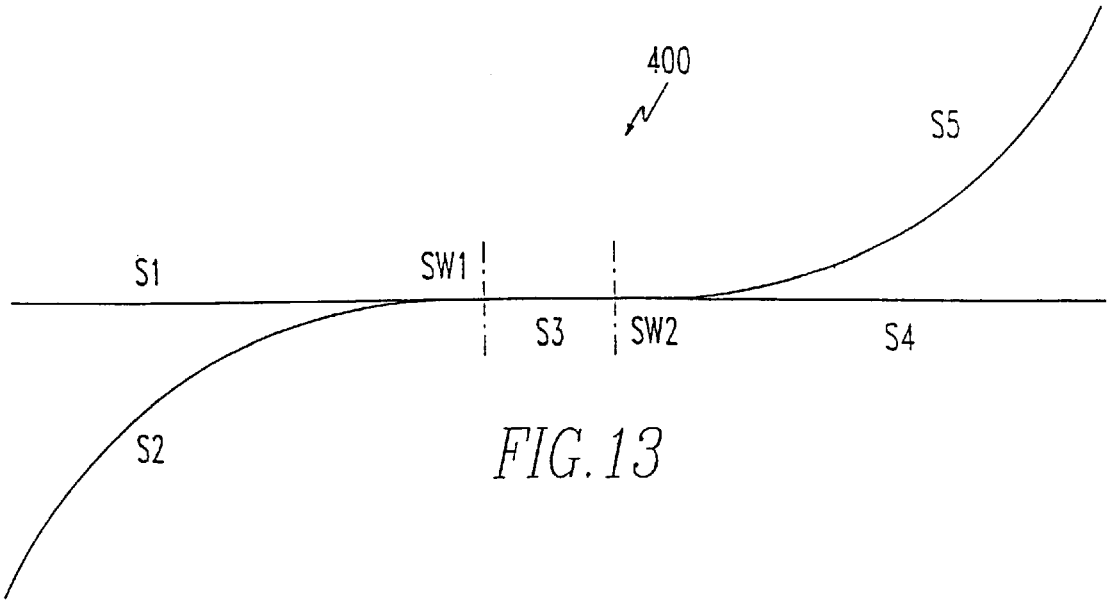
FIG. 13 is a schematic view of a slip switch portion of track for travel by a vehicle.

FIG. 13 shows a schematic view of a slip switch portion of track 400 which has two switches SW1 and SW2 placed together in series in an opposite orientation and coupled to five segments S1–S5. Each of the switches S1 and S2 has two states: normal and reverse. In the normal state, switches SW1 and SW2 are arranged so that segments S1, S3 and S4 are directly coupled. In the reverse state, switches SW1 and SW2 are arranged so that segments S2, S3 and S5 are directly coupled.

Figure 14:
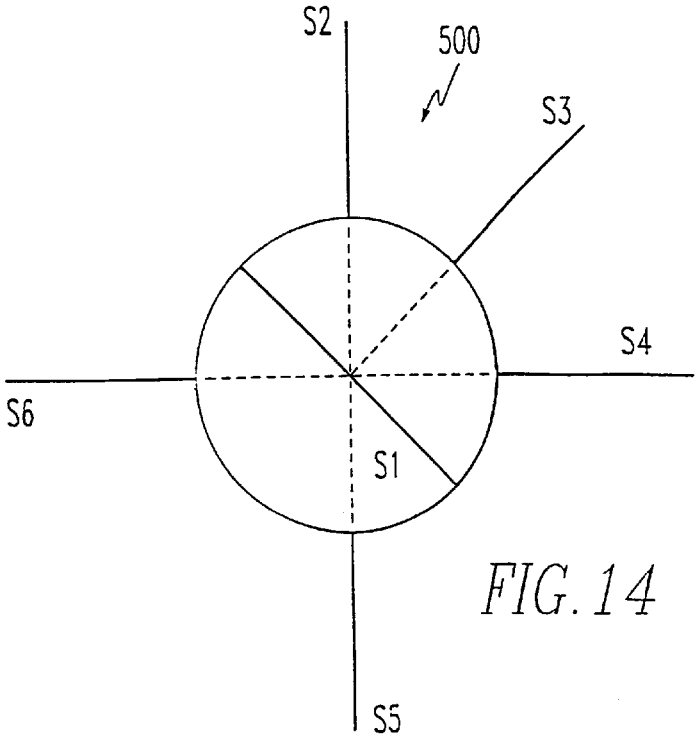
FIG. 14 is a schematic view of a three position turn table for use in a rail system to rotate a vehicle to a number of different tracks.

FIG. 14 shows a schematic view of a turn table 500, where a vehicle can be placed on the turn table and the turn table rotated. This arrangement includes six segments S1–S6 and the turntable can be rotated in three positions P1, P2 and P3. In position P1, segments S1, S4 and S6 are directly coupled; in position P2, segments S1, S2 and S5 are directly coupled; and in position P3, segments S1 and S3 are directly coupled.

Figure 15:
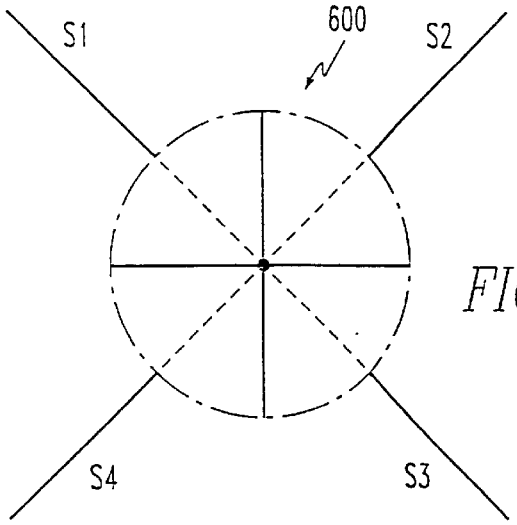
FIG. 15 is a schematic view of a two position turn table for use in a rail system to rotate a vehicle to a number of different tracks.

FIG. 15 shows a schematic view of another type of turn table 600 which has two positions: normal and reverse. In the normal position, segments S1 and S3 and segments S2 and S4 are directly coupled and in the reverse position, a vehicle traveling along segments S1 and S3 is changed so that it travels along segments S2 or S4, or vice versa.

Figure 16:
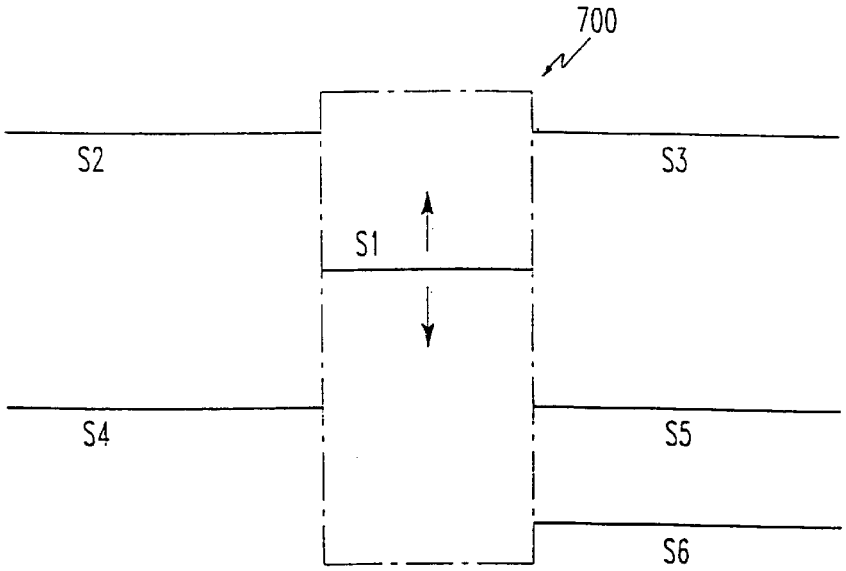
FIG. 16 is a schematic view of a three position transfer table for moving a vehicle to a number of different tracks.

FIG. 16 shows a schematic view of a transfer table 700, where a vehicle can be positioned on the transfer table 700 and moved to various tracks. This arrangement includes six segments S1–S6 and the turn table can be positioned in three positions P1, P2 and P3. In position P1, segments S1–S3 are directly coupled; in position P2, segments S1, S4 and S5 are directly coupled; and in position P3, segments S1 and S6 are directly coupled.

Figure 17:
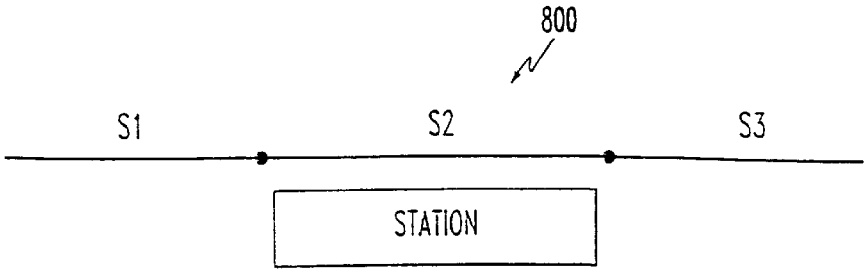
FIG. 17 is a schematic view of a portion of track representing a rail station.

FIG. 17 shows a schematic view of a station 800 that is represented by segment S2, which is directly coupled to segments S1 and S3. Many other simulated track arrangements can be provided which are made up of track segments having multiple positions and/or switches in a normal state, which are representative of actual track arrangements.

The above representative arrangements make it possible to easily trace a vehicle path from one segment to another. Specifically, referring back to FIG. 8, the map system includes two gauntlet portions of track 900 and 1000 (similar to that shown in FIGS. 9 and 10) and a slip switch portion of track 1100 (similar to that shown in FIG. 13). The positions of switches (normal or reverse) is dictated by the path a vehicle is to travel (for example, a vehicle traveling from segment S10 to segment S9 requires switches SW1 and SW2 to be in a reverse state and switches SW4 and SW7 to be in a normal state so that segments S10, S20 and S2–S9 are directly coupled to each other). As should now be evident, a vehicle path can easily be defined by identifying the switches SW1–SW7 in either a normal position or a reverse position.

A wayside computer containing map 20 also can include specific civil information or characteristics about the respective segments, such as maximum speed of vehicle travel on that segment, the segment grade, the segment curvature, whether the track ends at that segment (a null) and whether a station is positioned adjacent to the segment. This information can then be transmitted to the vehicle onboard computer and utilized in automatic vehicle control.

Further, each segment that is represented can be identified in an index where each index entry includes an identifier, or set of characteristics, for each segment. Each segment can have the following identifier: ABCDEFGHIJKLMNO, which is made up of a plurality of indicia, or characteristics, where:

A=Region ID—the region to which this segment belongs;

B=Track ID—the track to which this segment belongs;

C=Segment ID—a unique (within the region) identifier for this segment;

D=Segment Name—a name for this segment;

E=Segment Type—the type of segment track, switch point or transfer table or a station;

F=Normal Object Type—the type of object adjacent the segment in a normal direction of this segment (switch, segment or null);

G=Normal Object ID—a unique ID of the object in the normal direction;

H=Reverse Object Type—the type of object adjacent the segment in a reverse direction of this segment (switch, segment or null);

I=Reverse Object ID—a unique ID of the adjacent object in the reverse direction of reverse object;

J=Segment Length—the length of segment;

K=Speed—the maximum civil speed permitted in this segment;

L=Grade—the grade of segment;

M=Curvature—the curvature of segment;

N=Left Location—a reference to an absolute frame for fixed block systems only; and O=Right Location—reference to an absolute frame for fixed block systems only.

Optionally, in the case of switches, additional information can be provided relating to the position of the switch.

Utilization of this reference system can be illustrated using map 60 as shown in FIG. 8 and referring to segments S7, S8 and S9 and assuming the region is identified as region 1. With respect to segment S7, which has a segment length of $J_7$, a maximum civil speed permitted along the segment of $K_7$, a grade of $L_7$ and a curvature of 0:

A=1; B=1; C=S7; D=07; E=track; F=track; G=S8; H=switch; I=SW7; J=$J_7$; K=$K_7$; L=$L_7$; M=0; N=no value; and O=no value.

With respect to segment S8, which has a segment length of $J_8$, a maximum civil speed permitted along the segment of $K_8$, a grade of $L_8$ and a curvature of 0:

A=1; B=1; C=S8; D=08; E=track; F=track; G=S9; H=track; I=S7; J=$J_8$; K=$K_8$; L=$L_8$; M=0; N=no value; and O=no value.

With respect to segment S9, which has a segment length of $J_9$, a maximum civil speed permitted along the segment of $K_9$, a grade of $L_9$ and a curvature of 0:

A=1; B=1; C=S9; D=08; E=track; F=null; G=null; H=track; I=S7; J=$J_9$; K=$K_9$; L=$L_9$; M=0; N=no value; and O=no value.

Thus, by using the above arrangements for mapping a vehicle system, the position of a vehicle traveling throughout the transit system is maintained by using the entry/exit points of the wayside devices.

These relationships make it possible to trace a vehicle's path from one segment to another ending at a final destination as well as the exact location of the vehicle. For example, referring back to FIG. 8, the path a vehicle is to travel can be provided to the vehicle as it approaches S1 by a wayside computer, such as segments S1 to S2 to S3 to S4 to S5 to S6 to S7 to S8 to S9 This vehicle path is then stored in the vehicle computer 61. The vehicle then travels from segment S1 to segment S2, etc. as identified by the stored vehicle path. The vehicle computer 61, through a look-up table, identifies each segment in the previously identified format, ABCDEFGHIKJLMNO. Throughout a respective segment, the identifier information remains constant, such as Speed (K), Grade (L), and Curvature (M). Further, the adjacent segment indicia can also be identified. Therefore, appropriate power changes in engine speed can be made prior to entering the adjacent segment.

Prior art systems, such as U.S. Pat. No. 5,072,900, utilize many look-up tables to identify the segment grade, maximum segment speed and segment curvature. The vehicle's computer must continually monitor the vehicle's position and look-up tables to determine the segment grade, maximum segment speed and segment curvature. This prior art arrangement slows down computer processing time since every characteristic table (such as, speed, grade, curvature) must continually be monitored. This processing time problem is overcome by the present invention which, although continually monitors the vehicle's position, only needs to look up its segment identifier once when the vehicle approaches and enters the respective segment. The segment identifier provides all of the pertinent information for the entire length of the segment, where the segment grade, maximum segment speed and its track curvature are constant.

Therefore, the following look-up table or indexes can be provided for each segment:

| Segment Number or Name | Segment Identifier or Data |
|---|---|
| S1 | $(A'B'C'D'E'F'G'H'I'J'K'L'M'N'O'P')_1$ |
| S2 | $(A'B'C'D'E'F'G'H'I'J'K'L'M'N'O'P')_2$ |
| S3 | $(A'B'C'D'E'F'G'H'I'J'K'L'M'N'O'P')_3$ |
| S4 | $(A'B'C'D'E'F'G'H'I'J'K'L'M'N'O'P')_4$ |

Therefore, once the vehicle path is received by the onboard vehicle computer then as the vehicle approaches each segment the appropriate segment is identified in the look-up table and the indicia for the identifier is obtained.

Although previously the identifier was identified by a plurality of indicia ABCDEFGHIJKLMNO, other indicia can be used for the segment defined as follows:

A'=segment name—name of the segment, which can be called by its region number and segment number (i.e., RO1S13 for region 1, segment 13).

B'=segment type—the type of segment track, transfer, standard, platform, or station.

C'=segment length—the length of the segment.

D'=segment speed—the maximum civil speed permitted in the segment.

E'=grade—the grade of the segment.

F'=curvature—the radius of curvature of the segment.

G'=region number—the region to which this segment belongs.

H'=segment number—identifies the specific segment within a specific region.

I'=track number—the number of the track in which the segment resides.

J'=walkway—describes on which side of the track an emergency walkway resides (left, right, both, null).

K'=normal location—the absolute location of a normal end of a segment based upon the supplied civil drawings.

L'=reverse location—the absolute location of it reverse end of a segment based upon the supplied civil drawings.

M'=normal object type—the type of a wayside object that is connected to a segment when traveling in the normal direction.

N'=normal object ID—the identifier of the wayside object that is connected to a segment when traveling in the normal direction.

O'=reverse object type—the type of the wayside object that is connected to the segment when traveling in the reverse direction.

P'=reverse object ID—the identifier of the wayside object that is connected to the segment when traveling in the reverse direction.

Each segment includes definitions of all of the above data A', B', C', D', E', F', G', H', I', J', K', L', M', N', O', P'. As each segment is incurred by the vehicle, the vehicle, through the vehicle computer 61, immediately knows all of the segment's characteristics. The vehicle computer does not have to go through the process to seek other tables to identify its speed, grade, segment type, etc., thus saving crucial time of the on board vehicle computer 61.

Therefore, the present invention is a method for controlling an automated controlled vehicle along a vehicle path including the steps of: a) providing a vehicle path; b) providing a vehicle on the vehicle path; c) dividing the vehicle path into segments that contain a portion of the vehicle path; d) identifying each of the segments by an identifier or character string that includes characteristic information such as, for example, a maximum speed permitted on the segment; a segment grade; a segment curvature; and a segment length, wherein the characteristic information is constant throughout the segment; and e) utilizing characteristic information to control the vehicle on the vehicle path. By character string, it is meant that any identifier can be used and is not to be limited to only ASCII characters. The characteristic information can also include information relating to the segment region, the segment type and adjacent segment or track information. The segment path can be identified by a plurality of segments and the vehicle computer can include a look-up table whereby, as the vehicle approaches each new segment, that segment characteristic information is provided through a character string on the look-up table. The vehicle also will continually monitor its vehicle position within the segment so that the vehicle computer can identify when the vehicle is leaving the segment and using the look-up table contained characteristic information about the adjacent segment it is about to enter so that appropriate power and/or braking can be provided to the vehicle. Further, the vehicle path can be modeled utilizing these segment definitions.

Hence, the present invention permits defining segments that model complete characteristics of a portion of a vehicle path; and utilizes this segment information to model a vehicle pathway. Further, by using the above arrangements for mapping a vehicle system, the position of a vehicle traveling throughout the transit system is maintained by using the entry/exit points of the wayside devices. These relationships make it possible to trace a vehicle's path from one segment to another ending at a final destination as well as the exact location of the vehicle. Therefore, the present invention provides a universal communication based vehicle positioning system and a vehicle positioning system that can operate through a plurality of computers rather than one central computer.

Having described the presently preferred embodiments of the invention, it is to be understood that it may otherwise be embodied within the scope of the appended claims.

We claim:

1. A method for controlling an automated controlled vehicle along a vehicle path comprising the steps of:

a) providing a vehicle path;

b) providing a vehicle on said vehicle path;

c) dividing said vehicle path into segments that contain a portion of said vehicle path;

d) identifying each of said segments by a character string that identifies characteristic information, said characteristic information comprising:

(i) a maximum speed permitted on the segment;

(ii) a segment grade;

(iii) a segment curvature; and (iv) a segment length wherein said characteristic information is constant throughout said segment; and e) utilizing said characteristic information to automatically control said vehicle on said vehicle path.

2. A method for controlling an automated controlled vehicle along a vehicle path as claimed in claim 1, further comprising the step of dividing said vehicle path into regions wherein each of said region contains a portion of said vehicle path and each of said regions contain one or more of said segments, said character string comprising characters indicative of said segment and said region.

3. A method for controlling an automated controlled vehicle along a vehicle path as claimed in claim 1, further comprising the step of continually monitoring the vehicle position within said segment.

4. A method for controlling an automated controlled vehicle as claimed in claim 1, wherein said characteristic information further comprises a segment type.

5. A method for controlling an automated controlled vehicle as claimed in claims 1, wherein said characteristic information further comprises adjacent segments to said segment being traveled upon by said vehicle.

6. A method for controlling an automated controlled vehicle as claimed in claim 1, wherein the vehicle path is identified through a string of connecting segments.

7. A method for controlling an automated vehicle as claimed in claim 6, further comprising the step of:

using a look-up table to identify the character string of a respective segment.

8. A method for controlling an automated vehicle as claimed in claim 2, further comprising the step of identifying the position of said vehicle on said local coordinate system $S_{xyz}$, where:

S is a vehicle identifier;

$_x$ is a specific region;

$_y$ is a specific segment contained within the region; and $_z$ is the position of the vehicle within the specific segment.

9. A method for controlling an automated vehicle as claimed in claim 8, further comprising the step of:

identifying a direction of travel of the vehicle, wherein the position of said vehicle is identified as $S_{xyz}{}^A$ where:

$_A$ identifies the direction of travel of the vehicle.

10. A method for controlling an automated vehicle as claimed in claim 9, further comprising the steps of:

inputting the vehicle position $S_{xyz}{}^A$ into a computer;

inputting the segment characterizations into a computer;

determining permittable vehicle speed based upon the inputted information; and operating the vehicle at the permittable vehicle speed.

11. A method for controlling an automated vehicle as claimed in claim 1, further comprising the step of:

converting the position of vehicle from a local coordinate system to a global coordinate system $S_{x'y'}$, *where*:

S is a vehicle identifier;

$_{x'}$ is a longitudinal coordinate reading; and $_{y'}$ is a latitude coordinate reading.

12. A method for controlling an automated vehicle as claimed in claim 1, further comprising providing a plurality of computers, wherein each of said computers includes a map corresponding to at least a portion of said vehicle path, wherein the vehicle transmits its location to at least one of the computers that includes the map corresponding to the location of the vehicle.

13. A method for controlling an automated vehicle as claimed in claim 12, further comprising communicating the vehicle location between the computers.

14. A method for controlling an automated vehicle as claimed in claim 13, wherein at least two computers have map information corresponding to the same portions of the vehicle path.

15. A method for controlling an automated vehicle as claimed in claim 14, wherein a plurality of vehicles travels on the vehicle path at the same time and relay their position information to said computers.

16. A method for controlling an automated vehicle as claimed in claim 15, wherein said information of said vehicles position is used to control the positioning of said vehicles on said vehicle path.

17. A method for controlling an automated vehicle as claimed in claim 1, wherein the vehicle path is a train track and the vehicle is a train.

18. A method for controlling an automated vehicle as claimed in claim 13, wherein the vehicle path comprises a plurality of tracks.

19. A map for an automated vehicle transport system for storage in a computer, comprising:

a plurality of segments contained in one or more regions and said segments represent a path adapted for a vehicle to travel, each of said segments is identified by a character string that includes indicia relating to said region in which the segment is located, a length of said segment, a maximum civil speed permitted in said segment and a grade of said segment, wherein the length of said segment, the maximum civil speed permitted in said segment and the grade of said segment are constant throughout said segment, said character string further including indicia relating to an adjacent segment to said segment corresponding to said character string and vehicle path switching information.

20. A method for modeling a vehicle path comprising the steps of:

defining the vehicle path into a plurality of segments wherein said segments are representative of the vehicle path and the wayside;

identifying each segment with a segment name; and corresponding each segment name with an identifier that includes indicia relating to a length of said segment, a maximum civil speed permitted in said segment and a grade of said segment, wherein the length of said segment, the maximum civil speed permitted in said segment and the grade of said segment are constant throughout said segment, said character string further including indicia relating to an adjacent segment to said segment corresponding to said character string.

21. A method for modeling a vehicle path as claimed in claim 20, further comprising the step of defining a region that includes a plurality of segments wherein the segment identifier includes the region in which a respective segment is provided.

22. A method for modeling a vehicle path as claimed in claim 21 further comprising the step of identifying a position of a vehicle on the vehicle path by the specific region, the specific segment of the region and the position within the specific segment of the vehicle.

23. A method for modeling a vehicle path as claimed in claim 22, further comprising the step of identifying the vehicle by a vehicle name.

24. A method for modeling a vehicle path as claimed in claim 22, further comprising the step of identifying a route for the vehicle to travel along the vehicle path.

25. A method for modeling a vehicle path as claimed in claim 24, further comprising the step of providing the route for the vehicle to travel by listing the respective segment names identifying the route.

26. A method for modeling a vehicle path as claimed in claim 25, wherein the vehicle is a train and the vehicle path is a track.

* * * * *